US012522988B1

(12) United States Patent
Zhou et al.

(10) Patent No.: US 12,522,988 B1
(45) Date of Patent: Jan. 13, 2026

(54) EXTERNALLY ENCASED PREFABRICATED UHPC SLAB ARCH BRIDGE WITH CONCRETE-FILLED STEEL TUBE STIFF SKELETON

(71) Applicant: Chongqing Jiaotong University, Chongqing (CN)

(72) Inventors: Jianting Zhou, Chongqing (CN); Yang Zou, Chongqing (CN); Hong Zhang, Chongqing (CN); Jun Yang, Chongqing (CN); Jingzhou Xin, Chongqing (CN); Jingchen Leng, Chongqing (CN); Zhixiang Zhou, Chongqing (CN); Zhongya Zhang, Chongqing (CN); Yin Zhou, Chongqing (CN); Pengfei Men, Chongqing (CN)

(73) Assignee: Chongqing Jiaotong University, Chongqing (CN)

( * ) Notice: Subject to any disclaimer, the term of this patent is extended or adjusted under 35 U.S.C. 154(b) by 0 days.

(21) Appl. No.: 19/172,691

(22) Filed: Apr. 8, 2025

(51) Int. Cl.
*E01D 4/00* (2006.01)
*E01D 101/26* (2006.01)

(52) U.S. Cl.
CPC ..... *E01D 4/00* (2013.01); *E01D 2101/268* (2013.01)

(58) Field of Classification Search
CPC ..... E01D 4/00; E01D 2101/268
USPC ..... 14/24–26, 74.5, 77.1, 78
See application file for complete search history.

(56) References Cited

U.S. PATENT DOCUMENTS 852,971 A * 5/1907 Luten ..... E04B 7/08 14/54
886,666 A * 5/1908 Thomas ..... E04B 7/08 52/745.08
984,878 A * 2/1911 Aylett ..... E04D 9/00 52/750
1,356,025 A * 10/1920 Thomas ..... E01D 4/00 52/89

(Continued)

FOREIGN PATENT DOCUMENTS

CN 110042747 A 7/2019
CN 110700071 A * 1/2020 ..... E01D 19/00

(Continued)

*Primary Examiner* — Raymond W Addie
(74) *Attorney, Agent, or Firm* — Addison D. Ault; IPGentleman Intellectual Property Services, LLC

(57) ABSTRACT

An externally encased prefabricated ultra-high-performance concrete (UHPC) slab arch bridge with a concrete-filled steel tube stiff skeleton is provided. The arch bridge includes a concrete-filled steel tube stiff skeleton arch rib segment, where the concrete-filled steel tube stiff skeleton arch rib segment is arranged at four corners inside a concrete-filled steel tube stiff skeleton externally encased prefabricated UHPC slab arch rib segment, and the concrete-filled steel tube stiff skeleton externally encased prefabricated UHPC slab arch rib segment includes two web structures, where the top and bottom of the two web structures are respectively connected to a roof structure and a floor structure through a cast-in-situ UHPC longitudinal joint and a cast-in-situ UHPC transverse joint. The stiff skeleton externally encased concrete is prefabricated into a UHPC slab and then transported to the site for assembly, the UHPC is used as externally encased concrete to reduce the self-weight of the structure.

2 Claims, 2 Drawing Sheets

(56) References Cited

U.S. PATENT DOCUMENTS

| | | | | | |
|---|---|---|---|---|---|
| 4,644,978 | A * | 2/1987 | Bonasso | E04C 3/22 | 14/19 |
| 5,655,347 | A * | 8/1997 | Mahieu | E04C 3/42 | 52/642 |
| 6,138,309 | A * | 10/2000 | Tadros | E01D 1/005 | 29/897.3 |
| 6,243,994 | B1 * | 6/2001 | Bernini | E02D 29/045 | 405/126 |
| 6,401,285 | B1 * | 6/2002 | Morris | E01D 1/005 | 14/19 |
| 7,857,543 | B2 * | 12/2010 | Troster | E01C 1/002 | 404/1 |
| 2014/0223674 | A1 * | 8/2014 | Li | E01D 4/00 | 14/25 |
| 2019/0309488 | A1 | 10/2019 | Li et al. | | |

FOREIGN PATENT DOCUMENTS

| | | | | | |
|---|---|---|---|---|---|
| CN | 210975494 | U | | 7/2020 | |
| CN | 211006375 | U | | 7/2020 | |
| CN | 115559217 | A | | 1/2023 | |
| CN | 218880555 | U | * | 4/2023 | |
| CN | 116641310 | A | | 8/2023 | |
| CN | 117248438 | A | | 12/2023 | |
| CN | 117845718 | A | * | 4/2024 | E01D 4/00 |
| CN | 119083321 | A | * | 12/2024 | |

* cited by examiner

EXTERNALLY ENCASED PREFABRICATED UHPC SLAB ARCH BRIDGE WITH CONCRETE-FILLED STEEL TUBE STIFF SKELETON

TECHNICAL FIELD

The present invention relates to the technical field of concrete-filled steel tube stiff skeleton arch bridge, particularly to an externally encased prefabricated ultra-high-performance concrete (UHPC) slab arch bridge with a concrete-filled steel tube stiff skeleton.

BACKGROUND

In China, the basic transportation infrastructure network is constantly developing in the western mountainous areas, and the arch bridge is a very suitable bridge type in the mountainous terrain of China's western areas. Based on the background, stiff skeleton arch bridges have been widely used in China due to their high strength, high stiffness, strong spanning capacity, and good durability. The concrete-filled steel tube stiff skeleton arch bridge is an arch bridge that uses a concrete-filled steel tube as the stiff skeleton, formwork is suspended on it, and arch ring concrete is poured symmetrically and balanced in rings, sections, and layers, and finally closed and formed. As a novel steel reinforced concrete structure, this arch bridge not only harnesses the strengths of concrete-filled steel tubes, but also has the advantages of high strength, high stiffness, good dynamic performance, strong fire resistance and seismic resistance of steel reinforced concrete. However, there are several shortcomings in pouring externally encased concrete for this structural form: (1) the cast-in-situ ordinary concrete of externally encased concrete has a large self-weight of the whole structure, which limits the further increase of the span of arch bridge; (2) the workload of externally encased concrete is heavy and the construction period is long; (3) the requirement for the formwork precision of externally encased concrete is high, and it is difficult to perform the slipform construction, and the construction efficiency is low; (4) large-volume externally encased concrete is cast in situ at the construction site, and its pouring quality is difficult to guarantee; (5) the shrinkage and creep of ordinary concrete is large, and large-volume pouring of externally encased concrete may form micro-cracks in the externally encased concrete due to shrinkage and creep, thus affecting the durability of the structure; and (6) when pouring the externally encased concrete, a large number of disposable wooden formwork is required, which is not conducive to environmental protection.

SUMMARY

An objective of the present invention is to provide an externally encased prefabricated UHPC slab arch bridge with a concrete-filled steel tube stiff skeleton, which solves the problem that the conventional steel tube concrete stiff skeleton arch bridge externally encased concrete has large self-weight, shrinkage and creep, low construction efficiency, difficult quality guarantee, and the cast-in-situ externally encased concrete requires a large number of disposable wooden formwork making it is easy to cause material waste.

In order to achieve the above objective, the present invention provides an externally encased prefabricated UHPC slab arch bridge with a concrete-filled steel tube stiff skeleton, including a concrete-filled steel tube stiff skeleton arch rib segment, wherein the concrete-filled steel tube stiff skeleton arch rib segment is arranged at four corners inside a concrete-filled steel tube stiff skeleton externally encased prefabricated UHPC slab arch rib segment, and the concrete-filled steel tube stiff skeleton externally encased prefabricated UHPC slab arch rib segment includes two web structures, wherein the top and bottom of the two web structures are respectively connected to a roof structure and a floor structure through a cast-in-situ UHPC longitudinal joint and a cast-in-situ UHPC transverse joint.

Preferably, the concrete-filled steel tube stiff skeleton arch rib segment includes a hollow steel tube truss arch rib segment, core concrete is poured inside the hollow steel tube truss arch rib segment, and the hollow steel tube truss arch rib segment is fixedly connected to the cast-in-situ UHPC longitudinal joint through a plurality of headed studs.

Preferably, the web structure includes a prefabricated UHPC web, and a prefabricated UHPC web steel mesh arranged uniformly and equidistantly is distributed on the prefabricated UHPC web.

Preferably, the roof structure includes a prefabricated UHPC roof, and a prefabricated UHPC roof steel mesh arranged uniformly and equidistantly is distributed on the prefabricated UHPC roof.

Preferably, the floor structure includes a prefabricated UHPC floor, and a prefabricated UHPC floor steel mesh arranged uniformly and equidistantly is distributed on the prefabricated UHPC floor.

Preferably, a steel bar in cast-in-situ UHPC longitudinal joint arranged uniformly and equidistantly is distributed on the cast-in-situ UHPC longitudinal joint.

Therefore, the present invention adopts the above structure of the externally encased prefabricated UHPC slab arch bridge with the concrete-filled steel tube stiff skeleton, which has the following beneficial effects:

(1) in the present invention, the prefabricated UHPC slab is adopted as the externally encased concrete of concrete-filled steel tube stiff skeleton arch bridge, the UHPC has ultra-high mechanical properties, its self-weight can be greatly reduced under the same bearing capacity, and has potential to break through to a larger span.

(2) in the present invention, the externally encased concrete is prefabricated into the UHPC slab in a prefabrication factory and then transported to the factory for assembly, and the UHPC slab is connected into a whole by a cast-in-situ joint mode, the concrete pouring beam can be reduced by more than 70% at the construction site, and only a small amount of steel bar formwork operation is required at the site, the massive labor is saved, and the construction efficiency is higher and the economic benefit is better.

(3) in the present invention, the externally encased concrete is prefabricated into the UHPC slab, which can guarantee its quality, meanwhile, the shrinkage and creep is reduced, and micro-cracks caused by shrinkage and creep are slowed down.

(4) in the present invention, the cast-in-situ large-area externally encased concrete on the construction site is avoided, thereby avoiding a large number of disposable wooden formwork, which leads to a waste of materials, so it has good environmental and economic benefits.

(5) UHPC has ultra-high durability, when the UHPC is used as the externally encased concrete, the structure can have better durability and greatly reduce the later maintenance cost, meanwhile, it can also be used in corrosive environmental conditions such as ocean, etc.

(6) UHPC has ultra-high mechanical properties, when the UHPC is used as the externally encased concrete, it can be better matched with the internal concrete-filled steel tube, so that the externally encased UHPC and the internal concrete-filled steel tube can reach the limit almost simultaneously.

Further detailed descriptions of the technical scheme of the present invention can be found in the accompanying drawings and embodiments.

REFERENCE NUMERALS IN FIGURES

1—a concrete-filled steel tube stiff skeleton arch rib segment; 2—a prefabricated UHPC web; 3—a cast-in-situ UHPC longitudinal joint; 4—a prefabricated UHPC roof; 5—a prefabricated UHPC floor; 6—a prefabricated UHPC web steel mesh; 7—a prefabricated UHPC floor steel mesh; 8—a prefabricated UHPC roof steel mesh; 9—a headed stud; 10—a hollow steel tube truss arch rib segment; 11—core concrete; 12—a steel bar in cast-in-situ UHPC longitudinal joint; 13—a cast-in-situ UHPC transverse joint; 14—a concrete-filled steel tube stiff skeleton externally encased prefabricated UHPC slab arch rib segment.

DETAILED DESCRIPTION OF THE EMBODIMENTS

The technical scheme of the present invention is further explained below by drawings and embodiments.

Unless otherwise defined, the technical or scientific terms used in the present invention shall be those to which the present invention belongs. As used herein, the terms "first", "second", and the like do not denote any order, quantity, or importance, but rather are used to distinguish one element from another. Similar words such as "comprise" or "include" means that the elements or items preceding the word encompass the elements or items listed after the word and equivalents thereof, but do not exclude other elements or items. The terms "connected" or "connection" are not limited to physical or mechanical connections, but may include electrical connections, whether direct or indirect. "Up", "down", "left", "right", etc. are only used to indicate a relative positional relationship, which may change accordingly when the absolute position of the object being described changes.

EMBODIMENT

Figure 1:
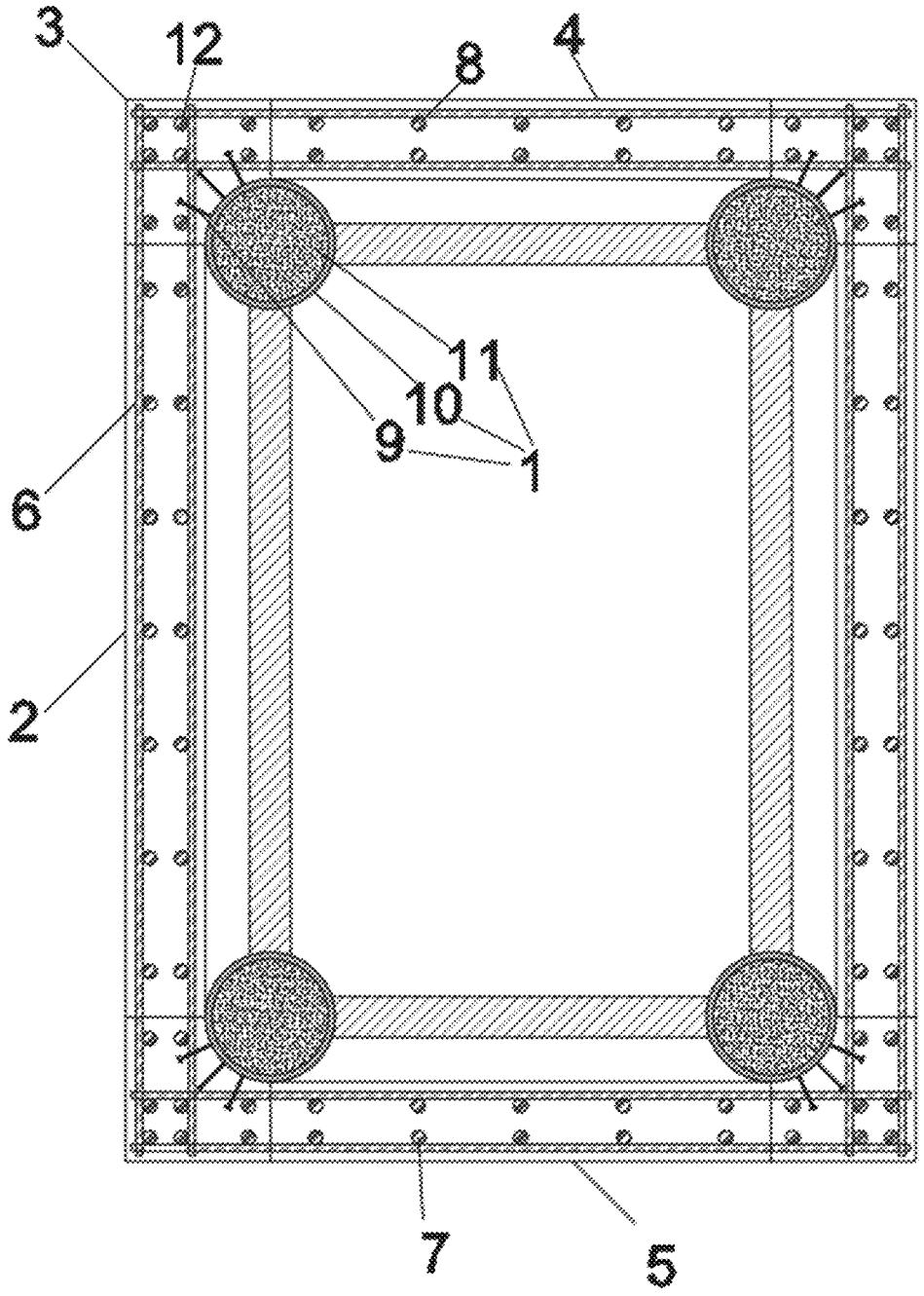
FIG. 1 is a schematic diagram of a cross-sectional structure of an externally encased prefabricated UHPC slab arch bridge with a concrete-filled steel tube stiff skeleton.
Figure 2:
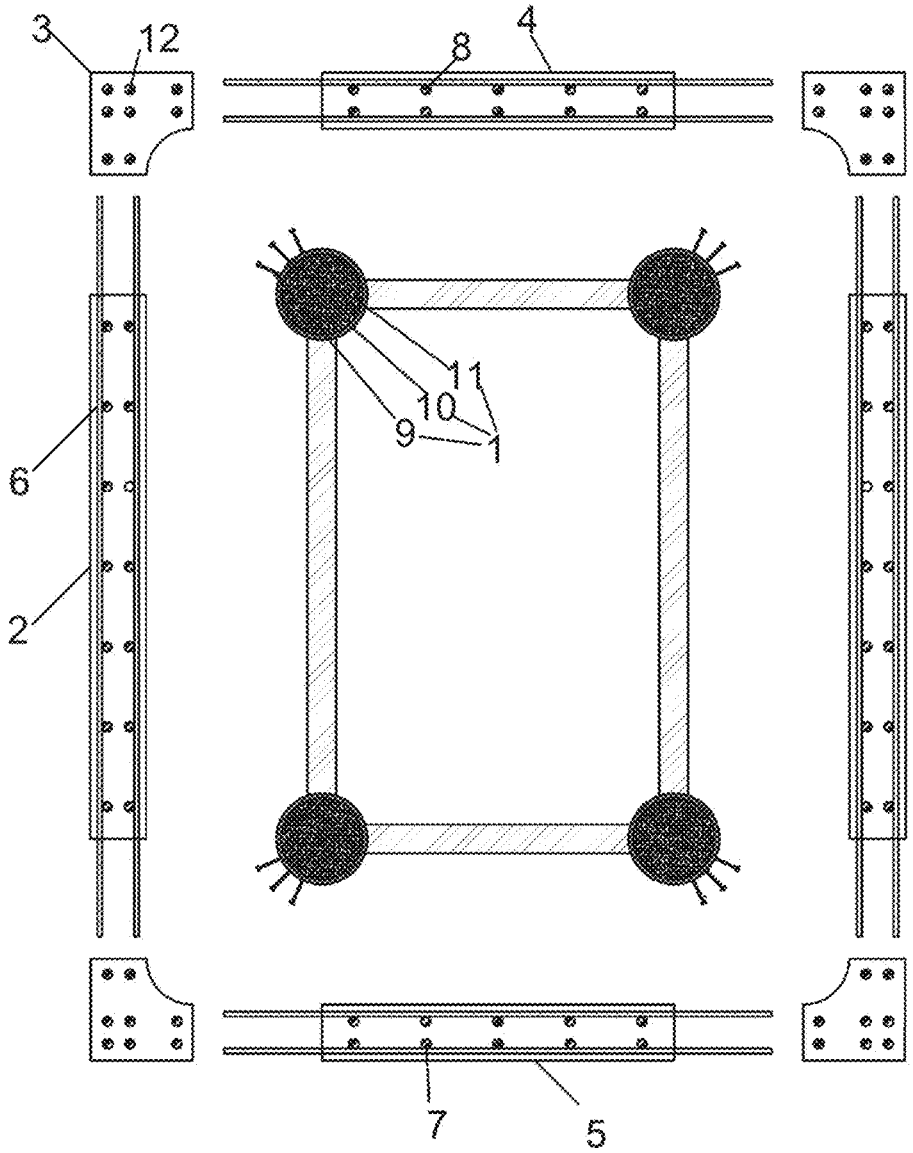
FIG. 2 is a schematic diagram of a concrete-filled steel tube stiff skeleton arch rib segment structure of an externally encased prefabricated UHPC slab arch bridge with a concrete-filled steel tube stiff skeleton.
Figure 3:
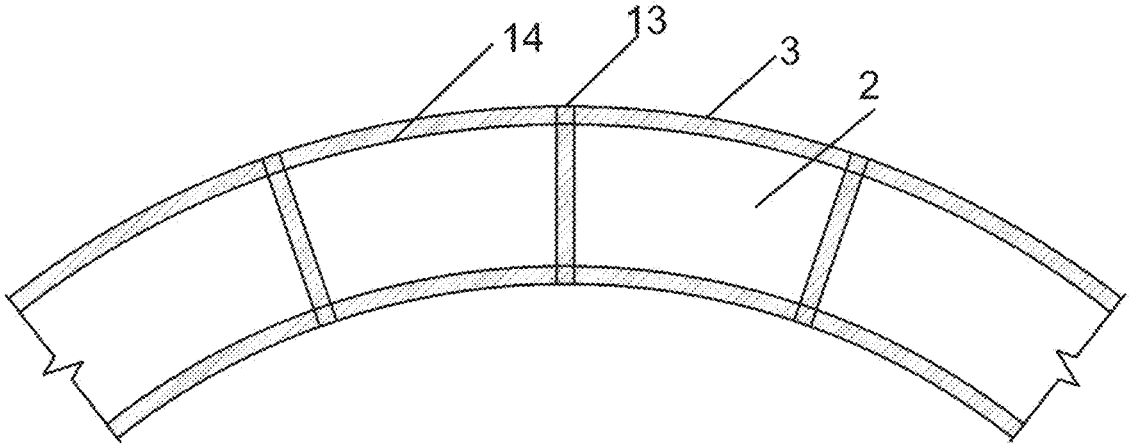
FIG. 3 is a schematic diagram of a facade structure of an externally encased prefabricated UHPC slab arch bridge with a concrete-filled steel tube stiff skeleton.

As shown in FIGS. 1-3, the present invention provides the externally encased prefabricated UHPC slab arch bridge with the concrete-filled steel tube stiff skeleton, including the concrete-filled steel tube stiff skeleton arch rib segment 1, wherein the concrete-filled steel tube stiff skeleton arch rib segment 1 is arranged at four corners inside the concrete-filled steel tube stiff skeleton externally encased prefabricated UHPC slab arch rib segment 14, and the concrete-filled steel tube stiff skeleton externally encased prefabricated UHPC slab arch rib segment 14 includes two web structures, wherein the top and bottom of the two web structures are respectively connected to the roof structure and the floor structure through the cast-in-situ UHPC longitudinal joint 3 and the cast-in-situ UHPC transverse joint 13.

The concrete-filled steel tube stiff skeleton arch rib segment 1 includes the hollow steel tube truss arch rib segment 10, core concrete 11 is poured inside the hollow steel tube truss arch rib segment 10, and the hollow steel tube truss arch rib segment 10 is fixedly connected to the cast-in-situ UHPC longitudinal joint 3 through a plurality of headed studs 9.

The web structure includes the prefabricated UHPC web 2, and the prefabricated UHPC web steel mesh 6 arranged uniformly and equidistantly is distributed on the prefabricated UHPC web 2.

The roof structure includes the prefabricated UHPC roof 4, and the prefabricated UHPC roof steel mesh 8 arranged uniformly and equidistantly is distributed on the prefabricated UHPC roof 4.

The floor structure includes the prefabricated UHPC floor 5, and the prefabricated UHPC floor steel mesh 7 arranged uniformly and equidistantly is distributed on the prefabricated UHPC floor 5.

The steel bar in cast-in-situ UHPC longitudinal joint 12 arranged uniformly and equidistantly is distributed on the cast-in-situ UHPC longitudinal joint 3.

The working principle is as follows:

S1: the required prefabricated UHPC roof 4, prefabricated UHPC floor 5 and prefabricated UHPC web 2 are prefabricated in the concrete prefabrication factory, the hollow steel tube truss arch rib segment 10 is prefabricated in the steel structure prefabrication factory and the headed studs 9 required to connect the various components are welded in the factory.

S2: the concrete-filled steel tube stiff skeleton arch rib segment 1 with headed studs 9 is erected at the construction site.

S3: the prefabricated UHPC roof 4, prefabricated UHPC floor 5 and prefabricated UHPC web 2 are transported to the construction site for assembly, and the prefabricated UHPC roof 4, prefabricated UHPC floor 5 and prefabricated UHPC web 2 are connected into a whole by pre-welded headed studs 9 and cast-in-situ UHPC longitudinal joint 3.

S4: after completing the above steps, the arch rib is longitudinally connected into a plurality of concrete-filled steel tube stiff skeleton externally encased prefabricated UHPC slab arch rib segments 14, and the plurality of concrete-filled steel tube stiff skeleton externally encased prefabricated UHPC slab arch rib segments 14 are connected to form the concrete-filled steel tube stiff skeleton arch rib through the cast-in-situ UHPC transverse joint 13.

The welding work of headed stud 9 is completed in the prefabricated factory to avoid the risk of high-altitude welding at the construction site.

The strength grade of the ordinary concrete filled in the hollow steel tube truss arch rib segment 10 and the prefabricated UHPC slab in factory is selected according to the actual engineering structure requirements.

The segment length of prefabricated UHPC roof 4, prefabricated UHPC floor 5 and prefabricated UHPC web 2 can be determined according to the hoisting capacity of the construction site and in combination with the self-weight of the prefabricated UHPC slab.

All the prefabricated UHPC roof steel mesh 8, prefabricated UHPC floor steel mesh 7 and prefabricated UHPC web steel mesh 6 of the prefabricated UHPC roof 4, prefabricated UHPC floor 5 and prefabricated UHPC web 2 are reserved for a certain length beyond the prefabricated slab, extended to the cast-in-situ UHPC longitudinal joint 3 and cast-in-situ UHPC transverse joint 13 to ensure its anchoring effect.

The amount of steel fiber in the prefabricated UHPC roof 4, prefabricated UHPC floor 5 and prefabricated UHPC web 2 is selected appropriately according to different engineering requirements.

The transverse steel bar of the prefabricated UHPC web 2, the prefabricated UHPC roof 4, and the prefabricated UHPC floor 5 of the same section should be arranged in a staggered manner to avoid clashes, similarly, the longitudinal steel bar of the adjacent concrete-filled steel tube stiff skeleton externally encased prefabricated UHPC slab arch rib segment 14 should also be arranged in a staggered manner to avoid clashes.

Therefore, the present invention adopts the above-mentioned externally encased prefabricated UHPC slab arch bridge with the concrete-filled steel tube stiff skeleton, the externally encased concrete of the conventional concrete-filled steel tube stiff skeleton arch bridge is prefabricated into the UHPC slab, which can reduce the cast-in-situ concrete by more than 70% at the construction site, greatly reduce the construction of formwork and steel bars, and improve the construction efficiency at the site, meanwhile, prefabrication in the factory eliminates the shrinkage and creep of concrete caused by the age difference of concrete pouring successively, thus slowing down the micro-cracks of externally encased concrete caused by shrinkage and creep, additionally, it can avoid the waste of materials caused by the use of a large number of wood formwork in the cast-in-situ concrete. The conventional externally encased ordinary concrete is improved to externally encased UHPC, because the ultra-high mechanical properties of UHPC can reduce its release and reduce its self-weight compared with the conventional externally encased ordinary concrete under the condition of ensuring the same bearing capacity, so it has the potential to further improve the stiff skeleton arch bridge.

Finally, it should be noted that the above examples are merely used for describing the technical solutions of the present invention, rather than limiting the same. Although the present invention has been described in detail with reference to the preferred examples, those of ordinary skill in the art should understand that the technical solutions of the present invention may still be modified or equivalently replaced. However, these modifications or substitutions should not make the modified technical solutions deviate from the spirit and scope of the technical solutions of the present invention.

What is claimed is:

1. An externally encased prefabricated ultra-high-performance concrete (UHPC) slab arch bridge with a concrete-filled steel tube stiff skeleton, comprising:

a concrete-filled steel tube stiff skeleton arch rib segment, wherein the concrete-filled steel tube stiff skeleton arch rib segment is arranged at four corners inside a concrete-filled steel tube stiff skeleton externally encased prefabricated UHPC slab arch rib segment, and the concrete-filled steel tube stiff skeleton externally encased prefabricated UHPC slab arch rib segment comprises two web structures, wherein a top and a bottom of the two web structures are respectively connected to a roof structure and a floor structure through a cast-in-situ UHPC longitudinal joint and a cast-in-situ UHPC transverse joint;

wherein the concrete-filled steel tube stiff skeleton arch rib segment comprises a hollow steel tube truss arch rib segment, core concrete is poured inside the hollow steel tube truss arch rib segment, and the hollow steel tube truss arch rib segment is fixedly connected to the cast-in-situ UHPC longitudinal joint through a plurality of headed studs;

wherein each of the two web structures comprises a prefabricated UHPC web, and a prefabricated UHPC web steel mesh arranged uniformly and equidistantly is distributed on the prefabricated UHPC web;

wherein the roof structure comprises a prefabricated UHPC roof, and a prefabricated UHPC roof steel mesh arranged uniformly and equidistantly is distributed on the prefabricated UHPC roof; and wherein the floor structure comprises a prefabricated UHPC floor, and a prefabricated UHPC floor steel mesh arranged uniformly and equidistantly is distributed on the prefabricated UHPC floor.

2. A construction method for the externally encased prefabricated UHPC slab arch bridge with the concrete-filled steel tube stiff skeleton according to claim 1, comprising:

S1: prefabricating the prefabricated UHPC roof, the prefabricated UHPC floor and the prefabricated UHPC web in a concrete prefabrication factory, prefabricating the hollow steel tube truss arch rib segment in a steel structure prefabrication factory, and welding the plurality of headed studs in a welding factory;

S2: erecting the concrete-filled steel tube stiff skeleton arch rib segment with headed studs at a construction site;

S3: transporting the prefabricated UHPC roof, the prefabricated UHPC floor and the prefabricated UHPC web to the construction site for assembly, wherein the prefabricated UHPC roof, the prefabricated UHPC floor and the prefabricated UHPC web are connected into a whole by the plurality of headed studs and the cast-in-situ UHPC longitudinal joint; and S4: after completing the above steps, connecting an arch rib is longitudinally into a plurality of concrete-filled steel tube stiff skeleton externally encased prefabricated UHPC slab arch rib segments, and connecting the plurality of concrete-filled steel tube stiff skeleton externally encased prefabricated UHPC slab arch rib segments to form a concrete-filled steel tube stiff skeleton arch rib through the cast-in-situ UHPC transverse joint;

wherein a steel bar in cast-in-situ UHPC longitudinal joint arranged uniformly and equidistantly is distributed on the cast-in-situ UHPC longitudinal joint.

* * * * *